US007810657B2

(12) United States Patent
Davison et al.

(10) Patent No.: US 7,810,657 B2
(45) Date of Patent: Oct. 12, 2010

(54) PRODUCT DISPLAY UNIT

(75) Inventors: Max Matthew Davison, Durban (ZA); Martin Cronje, Durban (ZA); Bevan Tilley, Richmond (GB); Melanie Lambrechts, Durban (ZA)

(73) Assignee: Cadbury Holdings Limited, Middlesex (GB)

( * ) Notice: Subject to any disclaimer, the term of this patent is extended or adjusted under 35 U.S.C. 154(b) by 437 days.

(21) Appl. No.: 11/897,004

(22) Filed: Aug. 28, 2007

(65) Prior Publication Data

US 2008/0053943 A1 Mar. 6, 2008

(30) Foreign Application Priority Data

Aug. 29, 2006 (GB) ..... 0616979.1

(51) Int. Cl.
*A47F 5/00* (2006.01)

(52) U.S. Cl. ..... 211/175; 211/193; 211/100; 211/104

(58) Field of Classification Search ..... 211/175, 211/193, 189, 45, 99–104; 248/230.6, 218.4, 248/219.4, 235, 250
See application file for complete search history.

(56) References Cited

U.S. PATENT DOCUMENTS

| | | | | | |
|---|---|---|---|---|---|
| 93,999 | A * | 8/1869 | Johnson et al. | ..... | 211/104 |
| 986,788 | A * | 3/1911 | Wilson | ..... | 211/85.3 |
| 2,087,757 | A * | 7/1937 | Foss | ..... | 211/119.008 |
| 2,481,797 | A * | 9/1949 | Turner | ..... | 211/97 |
| 3,158,113 | A * | 11/1964 | Johnson | ..... | 108/64 |
| 3,363,777 | A * | 1/1968 | Cooper | ..... | 211/85.3 |
| 4,729,535 | A * | 3/1988 | Frazier et al. | ..... | 248/230.4 |
| 5,458,248 | A * | 10/1995 | Alain | ..... | 211/175 |
| 5,553,722 | A * | 9/1996 | Lam | ..... | 211/99 |
| 5,855,283 | A * | 1/1999 | Johnson | ..... | 211/59.3 |
| 6,237,824 | B1 * | 5/2001 | Bagley | ..... | 224/521 |
| 6,332,548 | B1 * | 12/2001 | West et al. | ..... | 211/175 |
| 6,655,538 | B2 * | 12/2003 | Saulnier-Matteini | ..... | 211/153 |
| 6,799,523 | B1 * | 10/2004 | Cunha | ..... | 108/108 |
| 7,182,210 | B2 * | 2/2007 | Metcalf | ..... | 211/175 |
| 7,246,711 | B1 * | 7/2007 | Metcalf | ..... | 211/175 |
| 7,571,822 | B2 * | 8/2009 | Metcalf | ..... | 211/175 |

* cited by examiner

*Primary Examiner*—Janet M Wilkens
*Assistant Examiner*—Dan Rohrhoff
(74) *Attorney, Agent, or Firm*—Hoffman & Baron, LLP

(57) ABSTRACT

A product display unit (10) has a product support surface of selectively adjustable area. The unit comprises an attachment (13, 14) for securing to a support structure (15) and a cantilevered support member (11) extending from the attachment in a first length direction. A plurality of elongate support arms (23) extend lengthwise in a direction substantially perpendicular to said first length direction. Each support arm (23) is pivotably attached to the cantilevered support member for movement between a first position and a second position to vary the area of the product display unit available to support product. Each support arm may also be telescopically movable from the second position to a third position to further vary the product support area.

19 Claims, 5 Drawing Sheets

PRODUCT DISPLAY UNIT

BACKGROUND OF THE INVENTION

This invention relates to a product display unit and in particular, though not exclusively, to a display unit for the display of confectionery products.

Not infrequently a confectionery product manufacturer will provide a retailer with a point of sale product display unit which bears the manufacturers name and product brand identification for the purpose of displaying that manufacturer's products.

In consequence of seasonal changes in the demand for different types of product supplied by that manufacturer, and also the introduction of new product lines having differently sized packaging, an initially installed product display unit may cease to provide the desired product display area. Thus the product display area may become too great or too small.

It has been proposed to accommodate variations in the preferred product display area by providing components which can be used as "add-ons" or as replacement for components of the initially installed and assembled product display unit. That, however, suffers the disadvantage that is necessary to safely store display unit components when not in use. In practice there is a risk of the components which are not in use becoming lost or damaged. In addition it can be time consuming to install additional components or replace existing components.

SUMMARY OF THE INVENTION

The present invention seeks to provide a product display unit in which at least some of the afore-described disadvantages are mitigated or overcome.

In accordance with the present invention there is provided a product display unit having a product support surface of selectively adjustable area, said product display unit comprising:— attachment means for attachment to a support structure, a cantilevered support member extending from said attachment means in a first length direction, and a plurality of elongate support arms which each extend lengthwise in a direction substantially perpendicular to said first length direction, each support arm being attached to the cantilevered support member and movable between a first position and a second position to vary the area of the product display unit available to support product, characterised in that a support arm is movable between the first and second positions by pivotable movement.

A support arm may be movable between more than two positions. It may be movable between two positions by a movement of one type, such as a pivotal movement, and movable between two other positions by a movement of another type such as a telescopic movement.

All of the support arms may be movable in the same direction, and may be arranged to provide a substantially continuous support surface when in either of the first and second positions. Alternatively, however, some arms may be movable in a direction substantially opposite to that of one or more of the other arms, thereby then typically resulting a support surface having localised regions of discontinuity.

Preferably, when a support arm is in either the first or second support position, it defines a support surface which is substantially co-planar with a support surface of the other support arm(s).

In addition to the support surface area provided by the support arms, the cantilevered support member may comprise integral formations which also provide support surface regions, and said support surface regions similarly may be substantially co-planar with support surfaces defined by the support arms. The integral support formations may be in the form of support ribs which extend each in a direction substantially perpendicular to said first length direction. An integral support rib may be provided between each successive pair of support arms as considered in said first length direction.

A support arm may be pivotally mounted between a pair of said support ribs. Confronting surfaces of a pair of successive support ribs may comprise pivot formations to co-operate with formations on the support arm to provide for pivotal movement between said first and second positions.

The cantilevered support member may be of a fixed length in said first length direction, or may be extendable in said direction. It may comprise two or more sections movable by sliding movement relative to one another, for example by means of telescopic formations. Each support member section may have secured thereto a plurality of said support arms.

A part, such as a distal end region, of a support arm and/or a cantilevered support member may comprise an attachment formation for a structural member which, in use, may be employed for example to enhance structural stability of the display unit and/or to display product information such as product type, product brand or pricing.

These and other objects, advantages and features of the invention will be more readily understood and appreciated by reference to the detailed description of the invention and the drawings.

DETAILED DESCRIPTION OF THE INVENTION

Figure 1:
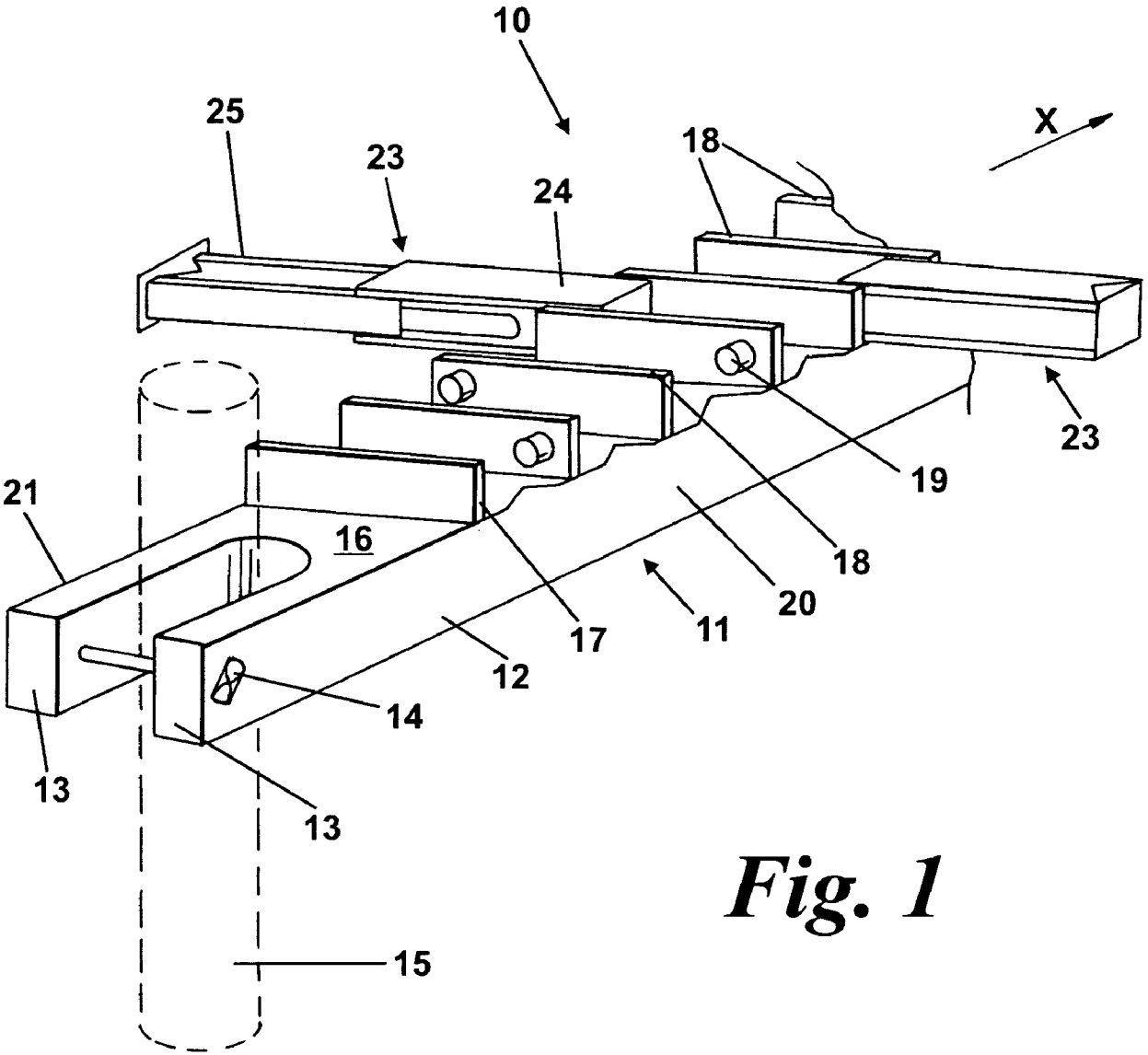
FIG. 1 is a perspective view of part of a product display unit in accordance with the present invention.
Figure 4:
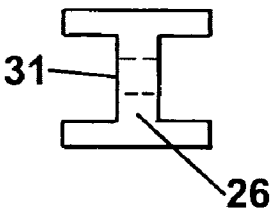
FIGS. 2, 3 and 4 are respectively side and end views of a first part of a support arm of the display unit of FIG. 1.
Figure 2:
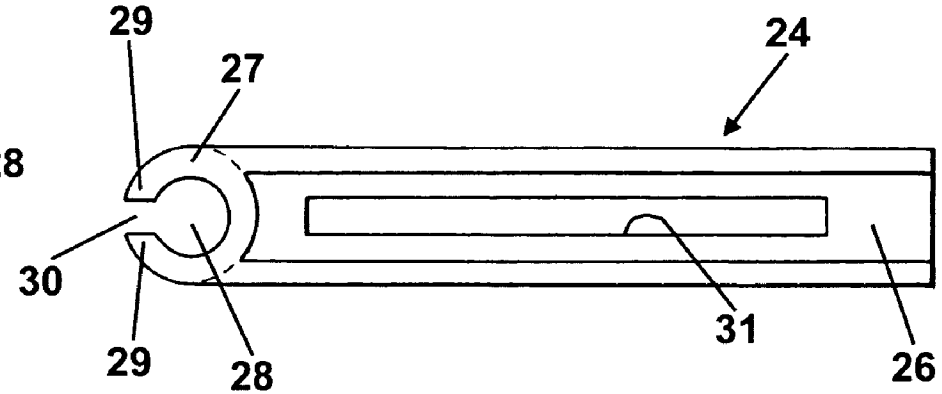
Figure 3:
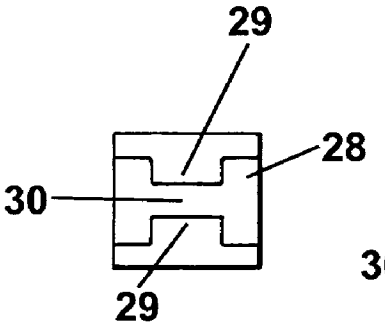

A product display unit 10 of moulded plastics material comprises a cantilevered support member 11 which extends lengthwise in the direction of the arrow X of FIG. 1. At one end 12 the support member is provided with a pair of slightly flexible jaws 13 which can be urged together by means of a bolt and nut assembly 14 to clamp the cantilevered support member to a vertical support post 15.

An upper face 16 of the cantilevered support member has formed integrally therewith a plurality of upstanding ribs 17 which each extend perpendicular to the direction X and which are each uniformly spaced in the direction X.

Each rib 17 defines an upper edge 18. The edges 18 of the ribs are co-planar and act as support surfaces for products positioned on the product display unit.

Confronting surfaces of each successive pair of ribs 17 each have moulded integrally therewith a hinge protrusion 19.

The two protrusions 19 of the confronting surfaces are aligned with one another and act, as described in more detail below, as pivot points for elongate support arms. The protrusions between one successive pair of confronting surfaces are provided close to one side 20 of the support member 11 whilst those provided by the next successive pair of confronting surfaces are close to the other side 21 of the support member. The pairs of hinge protrusions 19 alternate in a corresponding manner along the whole of the length of the cantilevered support member.

Each successive pair of hinge protrusions 19 provides pivotal mounting for a support arm 23 of a two part type construction as shown in FIGS. 2 to 7. A first part 24 is substantially in the form of an I section beam, with a guide slot 31 formed in the web section 26, between the ends thereof. At one end 27 the part 24 is formed with a pair of recesses 28 each to accommodate in the assembled condition a respective one of the hinge protrusions 19. Additionally, that end 27 has moulded integrally with the beam section a pair of jaw formations 29. The ends of the jaw formations are slightly spaced to provide a gap 30 which, in combination with flexibility of the jaws, allows a snap fit assembly of the protrusions 19 into the recesses 28.

Figure 7:
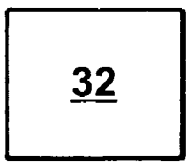
FIGS. 5, 6 and 7 are respectively side and ends views of a second part of a support arm.
Figure 5:
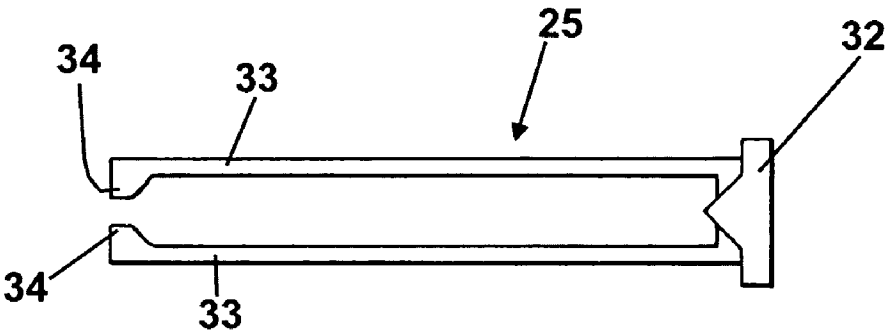
Figure 6:
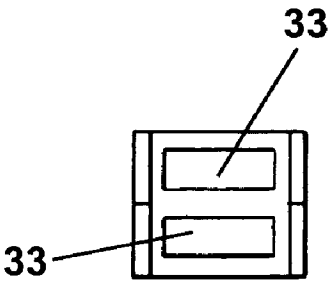

The afore-described first part 24 of the support arm 23 acts as a guide for telescopic movement of a second part 25 as shown in FIGS. 5 to 7.

The second part 25 of the support arm comprises an end formation 32 from which depends a pair of mutually parallel limbs 33. Each limb has at the distal end thereof a protrusion 34 which extends in a direction towards the other limb of the pair. The flexibility of the limbs 33 allows them readily to be assembled relative to the first part 24 with the two limbs lying either side of the web formation 26 of the first part 24 and with the protrusions 24 running in the guide slot 31 of the first.

The end portion 32 of each second part of each support arm is provided with a shape known per se to enable a display panel to be attached thereto in a snap fit manner. The shape is of a symmetrical type whereby a support panel may be secured thereto in either a first or a second, inverted position.

With a plurality of support arms fitted to the cantilevered support member the support arms can be positioned each to lie substantially wholly between a successive pair of ribs 17, thereby to provide a minimum support surface area for product display. The support surface area can then be increased by hinging outwards alternate support arms so as to lie to one side of the cantilevered support member. Rotational movement of the support arms is restricted by contact between the support arms and upper surface 16 of the cantilevered support member such that an upper surface of each outwardly extending support arm is substantially co-planar with the upper edges 18 of the support ribs. A further increase in product display area can then be achieved if required by pivoting outwards those other support arms which lie between the intervening successive pairs of ribs. Yet further increase in product support area can subsequently be achieved by employing the telescopic action of the two parts 24, 25 of each support arm such that each second part 25 lies further outwards from the cantilevered support member 11.

Figure 8:
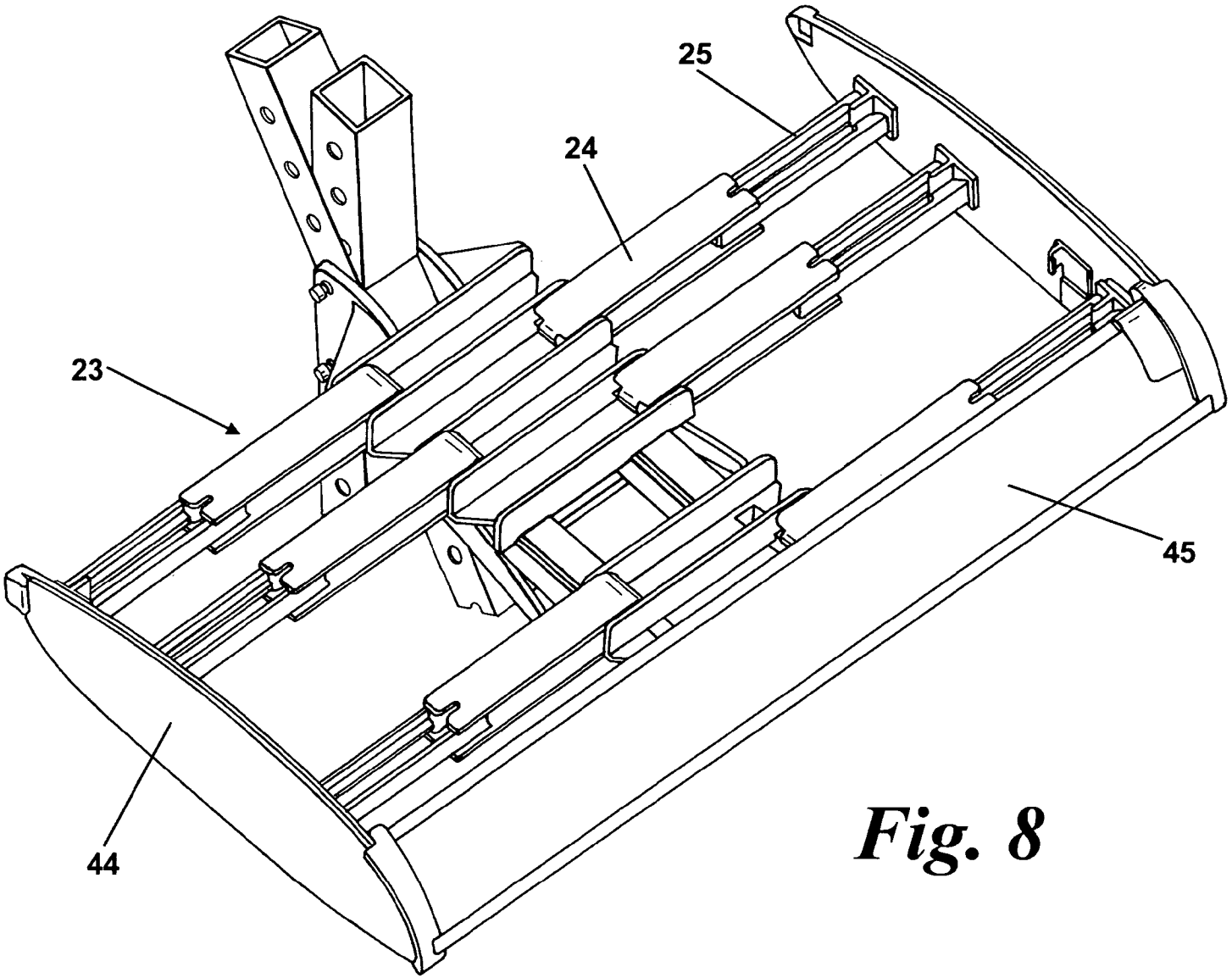
FIG. 8 is a perspective view of a display unit in accordance with the present invention in an extended condition.
Figure 9:
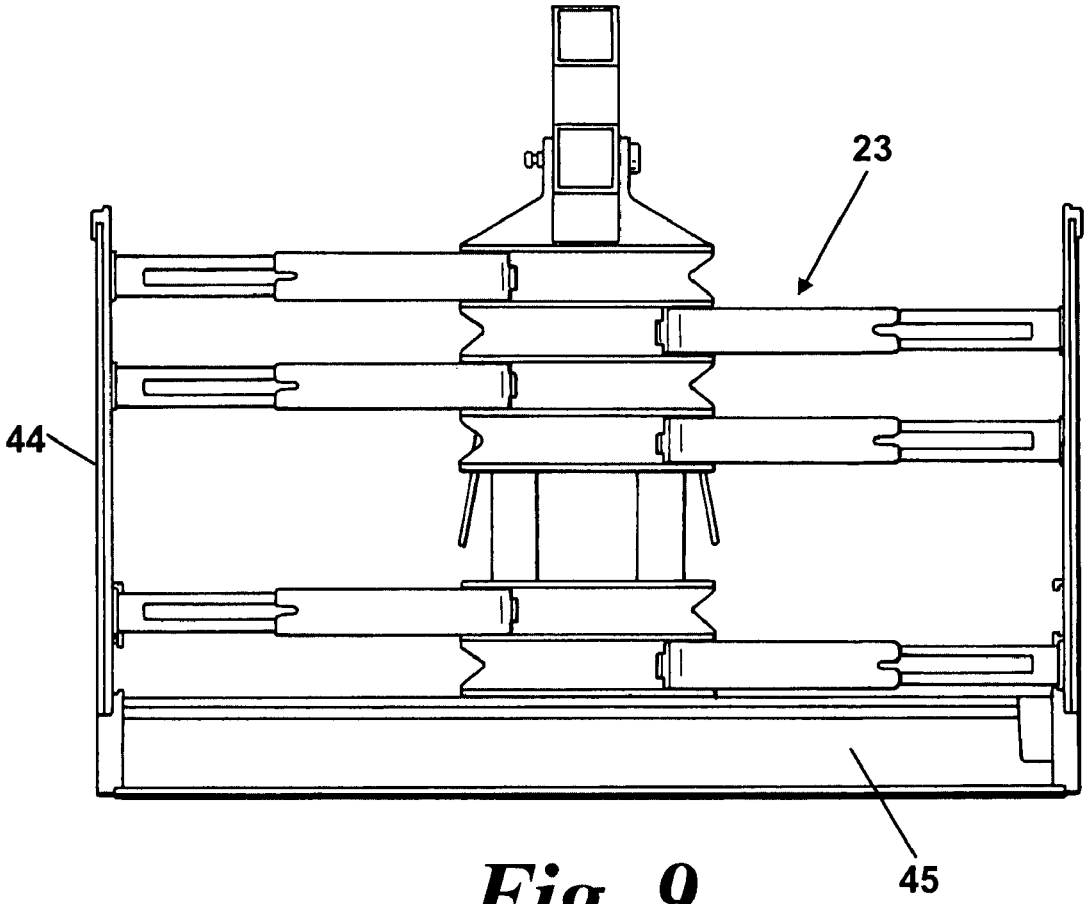
FIG. 9 is a plan view of the display unit of FIG. 8.
Figure 10:
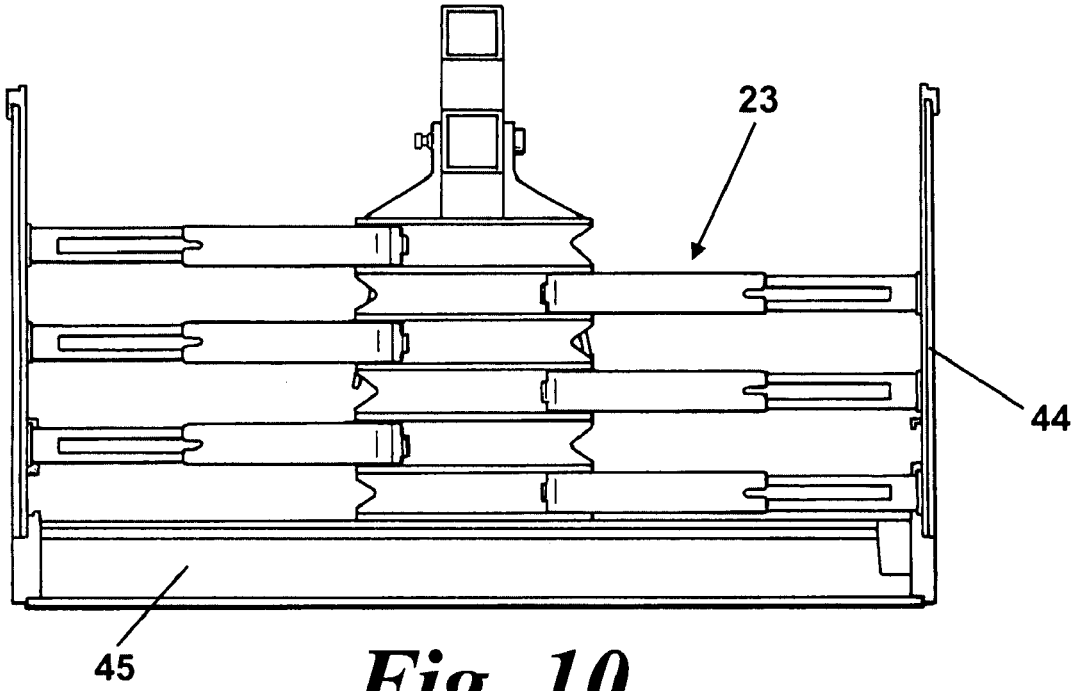
FIG. 10 shows the display unit of FIG. 8 contracted lengthways.

Although not described in detail herein, it is to be understood that the cantilevered support member itself may also be of a telescopic construction and able to extend in length in the direction X. A product display unit having the support arms 23 fully extended and also having a telescopic type support member 11 in the extended condition is shown in the FIGS. 8 and 9, FIG. 10 showing the same assembly contracted in the direction of the length X. FIGS. 8 to 10, and also FIG. 11, show structural display panels 44, 45 attached respectively to distal ends of support arms and the cantilevered support member.

Figure 11:
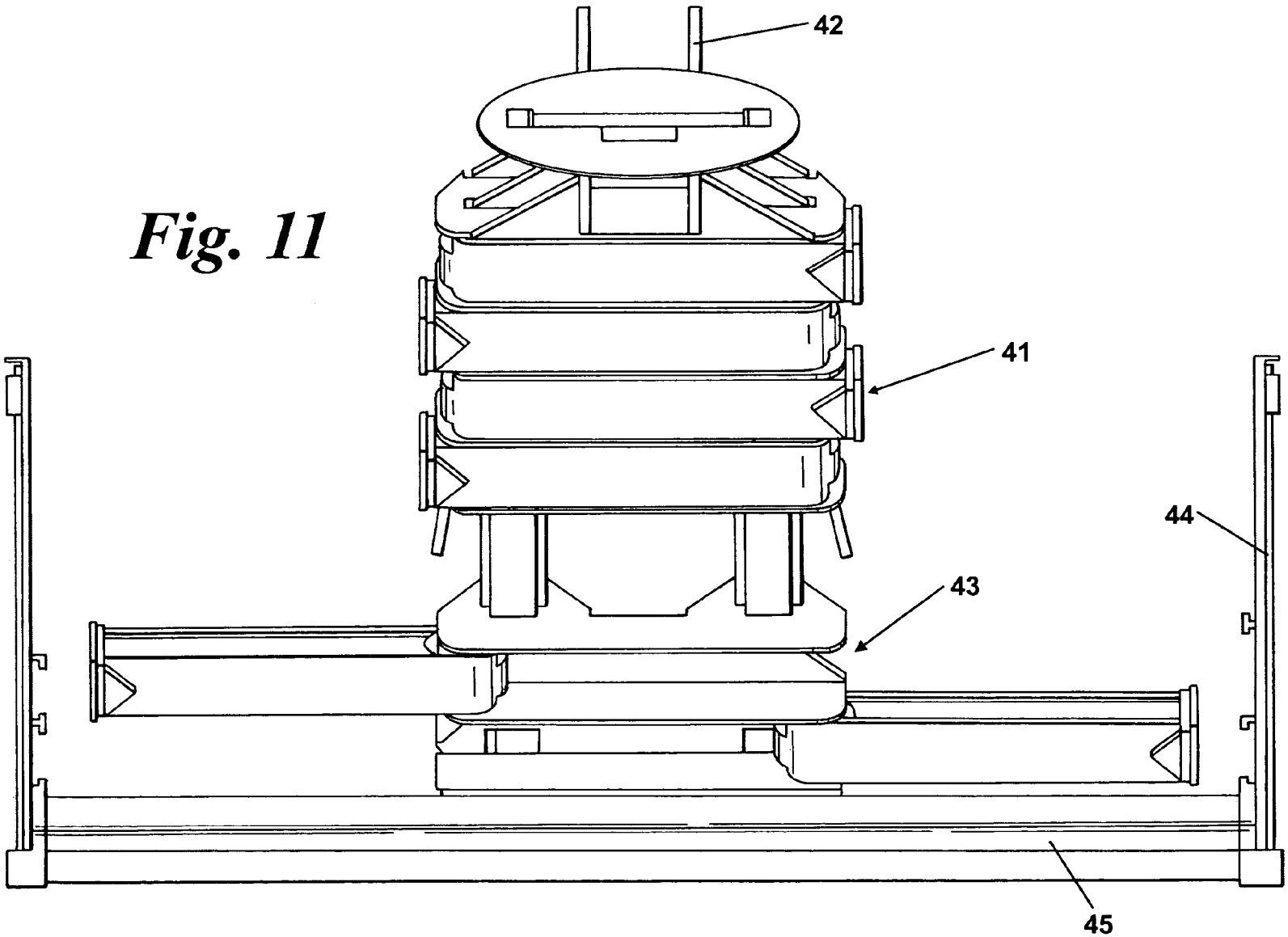
FIG. 11 shows the display unit of FIG. 8 having a part thereof contracted in width.

For comparison purposes FIG. 11 shows the manner in which a first part 41 of a telescopic type cantilevered support member 11, being a part nearest to the attachment end 42, is of minimum width, whereas a second telescopic part 43 of the cantilevered support arm has the support arms thereof extended to a condition to provide a maximum width.

Although it has been described that the product display unit comprises a support member of a cantilevered kind for extending in a single direction from a support structure, it is to be understood that the invention embraces also a product display unit of the kind comprising an attachment means positioned between ends of a cantilevered support member, that cantilevered support member thus extending outwards in two directions from the attachment means, for example into directions mutually opposite relative to one another.

What is claimed is:

1. A product display unit having a product support surface of selectively adjustable area, said product display unit comprising: attachment means for attachment to a support structure, a cantilevered support member extending from said attachment means in a first length direction, and a plurality of elongate support arms which each extend lengthwise in a direction substantially perpendicular to said first length direction, each support arm being attached to the cantilevered support member and movable between a first position and a second position to vary the area of the product display unit available to support product, wherein each support arm is movable between the first and second positions by a pivotable movement, each support arm includes a first part and a second part wherein said second part is movable in a telescoping manner from said first part, said second part includes an end formation with a pair of parallel limbs extending therefrom.

2. The product display unit of claim 1 wherein a support arm is movable between two positions by a pivotable movement and movable between two other positions by a different means of movement.

3. The product display unit of claim 2 wherein a support arm is movable between said two other positions by a telescopic action.

4. The product display unit of claim 1 wherein some arms are movable in directions substantially opposite to one or more of the other arms.

5. The product display unit of claim 1 wherein the cantilevered support member comprises integral support ribs which extend each in a direction substantially perpendicular to said first length direction and which provide support surfaces that are substantially co-planar with support surfaces defined by the support arm.

6. The product display unit according of claim 5 wherein an integral support rib is provided between each successive pair of support arms as considered in said first length direction.

7. The product display unit of claim 5 wherein a support arm is pivotally mounted between a pair of support ribs.

8. The product display unit of claim 1 wherein the cantilevered support member is extendable in length in said first length direction, the cantilevered support member comprising at least two sections movable relative to one another in said first length direction by a sliding movement and in which each support member section has secured thereto a plurality of said support arms.

9. The product display unit of claim 1 wherein a support arm or the cantilevered support member comprises an attachment formation for a structural member at a distal end region of the support arm or the cantilevered support member, and wherein, in use, said structural member provides the display unit with enhanced structural stability.

10. The product display unit of claim 1, wherein the first part has an I-beam geometry.

11. The product display unit of claim 10, wherein the first part includes a web-section with a guide slot therein.

12. The product display unit of claim 11, wherein one end of the first part includes a pair of jaws and a gap therebetween, said pair of jaws defining a recess therein.

13. The product display unit of claim 12, further including a plurality of ribs extending perpendicularly from said cantilevered support member.

14. The product display unit of claim 13, wherein said ribs include a protruding hinge, said hinge snap fitting within said recess.

15. The product display unit of claim 1, wherein each of said pair of parallel limbs include an inwardly facing protrusion at one end.

16. The product display unit of claim 1, wherein said pair of parallel limbs extends on either side of said first part.

17. The product display unit of claim 1, wherein said second part includes a display panel attached at one end.

18. A product display unit having a product support surface of selectively adjustable area, said product display unit comprising: attachment means for attachment to a support structure, a cantilevered support member extending from said attachment means in a first length direction, and a plurality of elongate support arms which each extend lengthwise in a direction substantially perpendicular to said first length direction, each support arm being attached to the cantilevered support member and movable between a first position and a second position to vary the area of the product display unit available to support product, wherein a support arm is movable between the first and second positions by a pivotable movement, wherein the cantilevered support member comprises integral support ribs which extend each in a direction substantially perpendicular to said first length direction and which provide support surfaces that are substantially co-planar with support surfaces defined by the support arm, wherein a support arm is pivotally mounted between a pair of support ribs, wherein confronting surfaces of pairs of successive support ribs comprise pivot formations to co-operate with formations on the support arm positioned therebetween to provide for pivotal movement of said support arm between said first and second support positions.

19. A product display unit having a product support surface of selectively adjustable area, said product display unit comprising: attachment means for attachment to a support structure, a cantilevered support member extending from said attachment means in a first length direction, and a plurality of elongate support arms which each extend lengthwise in a direction substantially perpendicular to said first length direction, each support arm being attached to the cantilevered support member and movable between a first position and a second position to vary the area of the product display unit available to support product, wherein each support arm includes a first part and a second part, said first part has an I-beam geometry with a web-section and a guide slot therein, said second part includes an end formation with a pair of parallel limbs extending therefrom, said pair of parallel limbs include an inwardly facing protrusion at one end, said inwardly facing protrusion snap fits into said guide slot of said first part to allow for telescoping movement of said second part from said first part.

* * * * *